US006190194B1

(12) United States Patent
Kubota

(10) Patent No.: US 6,190,194 B1
(45) **Date of Patent: *Feb. 20, 2001**

(54) ATTACHMENT AND CONNECTION STRUCTURE OF ELECTRICAL EQUIPMENT UNIT

(75) Inventor: Minoru Kubota, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/080,933

(22) Filed: May 19, 1998

(30) Foreign Application Priority Data

May 21, 1997 (JP) ..... 9-130900

(51) Int. Cl.[7] ..... H01R 13/64
(52) U.S. Cl. ..... 439/378; 439/929
(58) Field of Search ..... 439/378, 680, 439/929, 374

(56) References Cited

U.S. PATENT DOCUMENTS 3,141,721 * 7/1964 Horn ..... 439/680
4,627,759 * 12/1986 Kato et al. ..... 439/680
4,913,665 * 4/1990 Sacksen ..... 439/680
5,885,088 * 3/1999 Brennan et al. ..... 439/378
5,975,935 * 11/1999 Yamaguchi et al. ..... 439/374

FOREIGN PATENT DOCUMENTS 8-318761 12/1996 (JP) .

* cited by examiner

*Primary Examiner*—Paula Bradley
*Assistant Examiner*—Katrina Davis
(74) *Attorney, Agent, or Firm*—Armstrong, Westerman, Hattori, McLeland & Naughton

(57) ABSTRACT

An attachment and connection structure of an electrical equipment unit is provided. The electrical equipment unit is provided with a connector. When the electrical equipment unit is inserted into a unit receiving portion, the connector 21 can be connected to a mating connector of a unit receiving portion at the same time. A guide wall is formed unitarily on the connector, and a guide receiving portion for receiving the guide wall is provided to the unit receiving portion. The mating connector is disposed in the vicinity of the guide receiving portion. The guide wall also serves as part of the outer walls of the connector. The guide wall protrudes from the both sides and the front edge of the connector. After the guide wall is engaged with the guide receiving portion, engagement of both connectors starts.

6 Claims, 3 Drawing Sheets

ATTACHMENT AND CONNECTION STRUCTURE OF ELECTRICAL EQUIPMENT UNIT

BACKGROUND OF THE INVENTION

1. Field of the Invention

The present invention relates to an attachment and connection structure for attaching an electrical equipment such as a meter unit to the instrument panel of a vehicle, and securely connecting the electrical equipment unit to a connector provided to the instrument panel.

2. Related Art

FIG. 5 shows an attachment and connection structure of an electrical equipment disclosed in Japanese Patent Application No. 7-124859 filed by the present applicant.

In this structure, an electronic unit 52 is attached unitarily on the rear surface of a meter unit 51 by connector connection. The meter unit 51 is attached to a finish panel 53, thereby forming a cluster module 60. The finish panel 53, i.e., the cluster module 60, is then mounted to an instrumental panel 54, and a connector 55 of the electronic unit 52 is then engaged with a receiving connector 57 of a car wire harness 56.

The finish panel 53 is provided with lights and a switch unit 58 such as a hazard and a door mirror control. The electronic unit 52 includes the power sources and functions to integrate or distribute input and output signals. The switch unit 58 is connected to the meter unit 51 by a connector 59. The meter unit 51 is mounted to the finish panel provided with the switch unit, thereby forming the cluster module 60.

The finish panel 53 has a guide protrusion 61, and a receiving portion 63 for receiving the guide protrusion 61 is provided to the inner wall of a receiving chamber 62 on the side of the instrument panel 54. The receiving connector 57 is attached to a back wall 64 of the receiving chamber 62 in vertically and transversely movable condition. As the guide protrusion 61 slides along the receiving portion 63, the finish panel 53 is guided into the receiving chamber 62 and then connected to the electronic unit 52, with the receiving connector 57 correcting the displacement with the mating connector 55. An automatic temperature control unit 65 is included in a receiving chamber 66, and connected to the receiving connector 67 of the car wire harness 56.

With the above conventional structure, however, there has been a problem that when the finish panel 53 is attached to the instrument panel 54, pressing load is exerted on the front surface of the finish panel 53 away from the receiving connector 57. This causes a problem that the parts other than the connector attachment portions need to have rigidity, thereby making the construction more complicated and increasing the weight. Furthermore, if the distance from the connectors 55 and 57 to the guide protrusion 61 and the receiving portion 63 is long, the dimensional tolerance becomes greater, making it necessary to widen the movable range of the connector 57. What is worse, since the connectors 55 and 57 become hidden when the finish panel 53 is attached to the instrument panel 54, it is difficult to determine whether the connectors 55 and 57 are securely connected or not, thus reducing reliability in connection.

SUMMARY OF THE INVENTION

The principal object of the present invention is to provide an attachment and connection structure which securely connects an electrical equipment unit such as a meter unit, a switch unit, an electronic unit, or a temperature control unit, to an instrument panel or the like. With this attachment and connection structure, the construction of the connection portion can be made simpler and smaller. The movable range of the connector can also be restricted to a smaller range.

To achieve the above object, the present invention provides an attachment and connection structure of an electrical equipment unit which is characterized as follows. The electrical equipment unit is provided with a connector, and attached to the unit receiving portion. At the same time, the connector is connected to a mating connector provided to the unit receiving portion. A guide wall is unitarily formed on the connector, and the unit receiving portion is provided with a guide receiving portion for receiving the guide wall. The mating connector is disposed in the vicinity of the guide receiving portion.

The guide wall may also serve as part of the outer wall of the connector. This guide wall protrudes from both sides and the front of the connector. After the guide wall is engaged with the guide receiving portion, the above connectors are engaged.

In accordance with the first aspect of the present invention, as the guide wall is formed unitarily on the connector of the electrical equipment unit, the distance between the guide portion and the connector is eliminated, so that the guide wall can be engaged with the guide receiving portion while the connectors are smoothly and securely engaged to each other, even if the mating connector is movably supported. Since no movable mechanism is required for the connectors, the construction can be simpler, and the connecting portion can be made lighter and smaller. Reliability in connection can also be increased. In accordance with a second aspect of the present invention, as the guide wall also serves as part of the outer wall of the connector, the construction can be made even simpler, lighter, and smaller. In accordance with a third aspect of the present invention, the guide wall is securely engaged with the guide receiving portion, and the connector is guided in the engagement direction. In accordance with a fourth aspect of the present invention, the positions of the connectors are adjusted to each other by virtue of the engagement of the guide wall with the guide receiving portion, so that the connectors can surely be engaged to each other.

The above and other objects and features of the present invention will be more apparent from the following description taken in conjunction with the accompanying drawings.

DETAILED DESCRIPTION OF THE PREFERRED EMBODIMENTS

The following is a detailed description of the embodiments of the present invention, with reference to the accompanying drawings.

Figure 1:
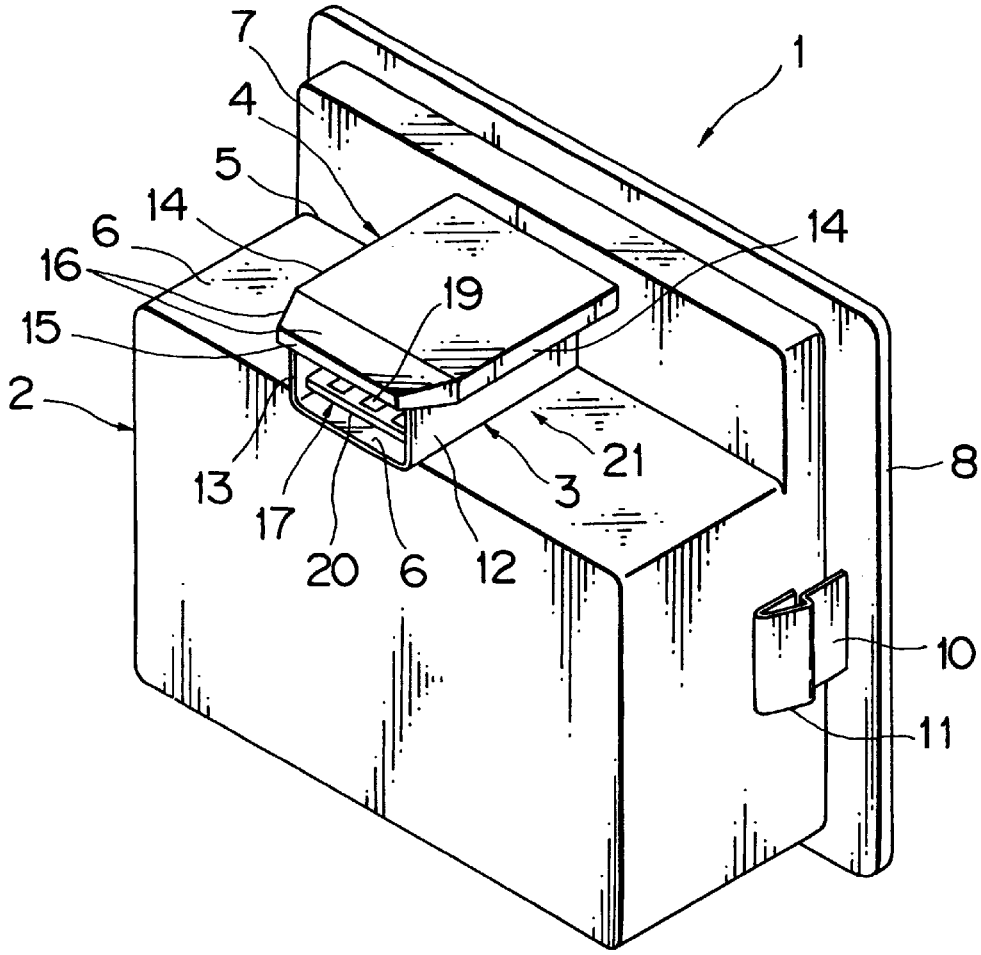
FIG. 1 is a perspective view of one example of an electrical equipment unit in accordance with the present invention.
Figure 3:
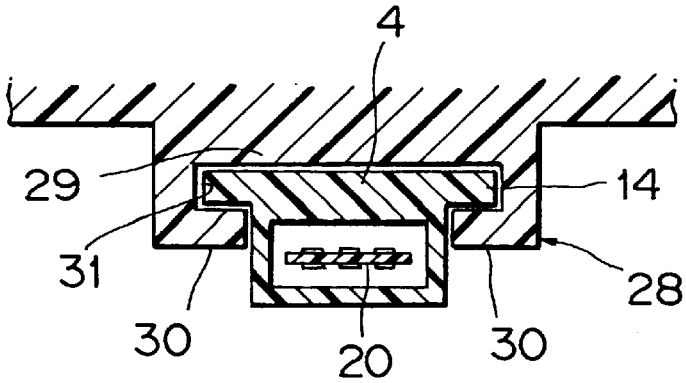
FIG. 3 is a vertical sectional view illustrating how the guide wall is engaged with the guide receiving portion.
Figure 2:
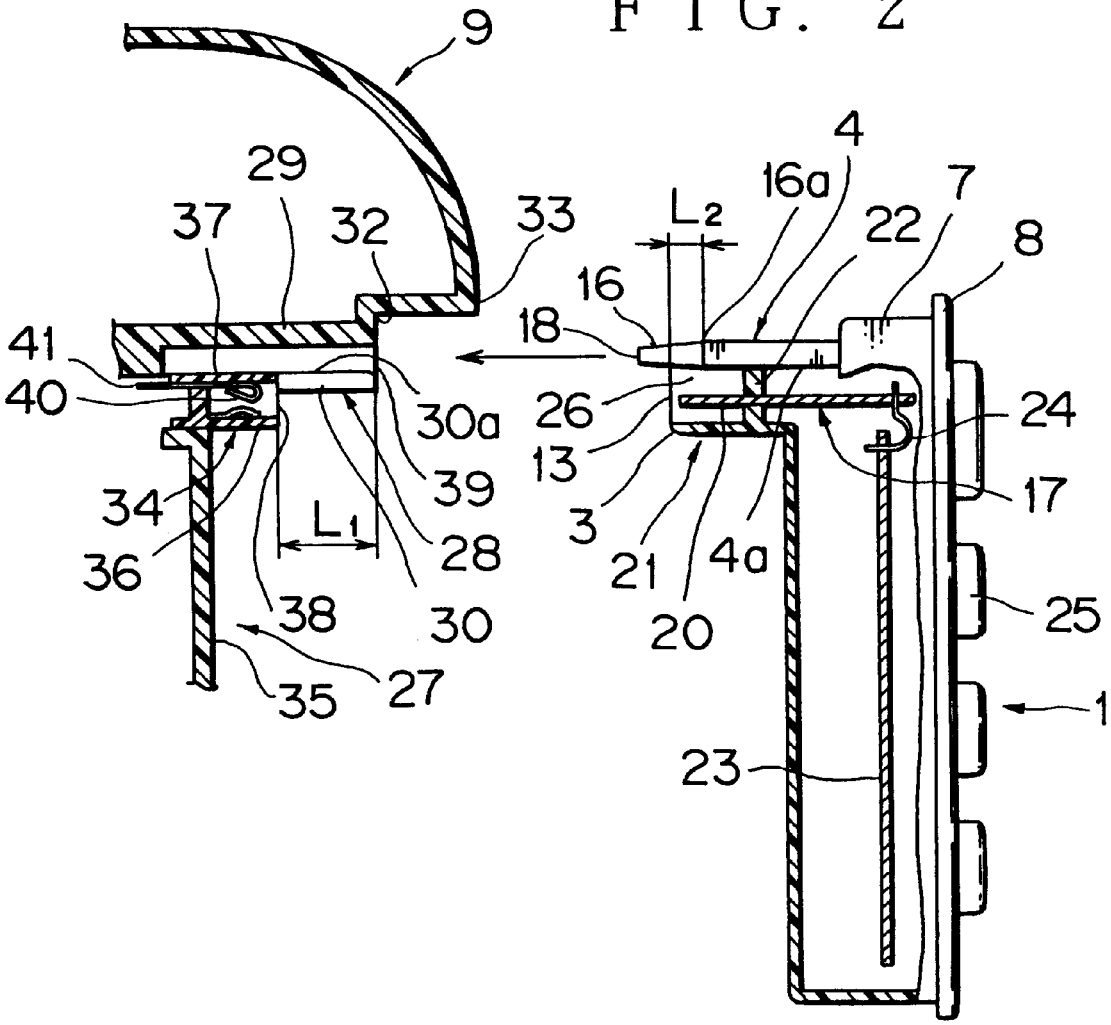
FIG. 2 is a vertical sectional view of a first embodiment of the attachment and connection structure of the electrical equipment unit.

FIGS. 1 to 3 show one embodiment of an attachment and connection structure of an electrical equipment unit in accordance with the present invention.

The electrical equipment unit 1 shown in FIG. 1 comprises a unit casing 2 made of a synthetic resin, a box-like connector housing 3 formed unitarily on the unit casing 2, and a thick horizontal guide wall 4 formed unitarily on the connector housing 3. The guide wall 4 also serves as the upper wall of the connector housing 3.

A step portion 5 is provided to the unit casing 2, and the connector housing 3 is formed on the step portion 5. The lower wall 6 of the connector housing 3 also serves as the upper wall 6 of the unit casing 2. The rear edge of the connector housing 3 also serves as the stand wall 7 of the unit casing 2. A flange portion 8 is formed at the front edge of the unit casing 2. At least a pair of flexible stop clamps 11 each having a stop protrusion 10 for an instrument panel 9 is provided to the rear surface of the flange portion 8.

The guide wall 4 united with the connector housing 3 is thicker than the outer walls 6 and 12 of the connector housing 3, and horizontally wider than the connector housing 3. The guide wall 4 also protrudes from the engagement edge (opening) 13 of the connector housing 3 in the connector engagement direction (i.e., toward the instrument panel). The base portion of the guide wall 4 continues to the stand wall 7. The flange portions 14 of the guide wall 4 extend horizontally, and the protruding portion 15 at the front edge has four tapered guide surfaces 16 which are the upper and bottom surfaces, and the two side surfaces of the protruding portion 15.

A printed circuit board (PCB) 17 is provided inside the connector housing 3 having a plurality of terminals 19 which are formed in parallel with each other and face to the engagement opening 13 of the connector housing 3. The printed circuit board 17 constitutes a card edge connector 20, and the printed circuit board 17 and the connector housing (hood) 3 constitute a female connector 21. The printed circuit board 17 is forced into the connector housing 3 or formed unitarily with the connector housing 3.

As shown in FIG. 2, the printed circuit board 17 extends horizontally, penetrating a partition wall 22 inside the connector housing 3. The printed circuit board 17 is connected to a vertical circuit board 23 disposed inside the unit casing 2 by a connecting means 24 such as a wire or a terminal. An electric unit (not shown) for controlling the functions of the unit 1 is mounted to the printed circuit board 17. If an electric control circuit capable enough to satisfy the functions of the unit 1 cannot be formed on the printed circuit board 17, the electric unit will be mounted to the circuit board 23. Various kinds of switches 25 are disposed on the front side of the unit 1, and they are connected to the circuit board 23.

A connector engagement chamber 26 is situated below the guide wall 4, and the terminal portion (card edge connector) 20 of the printed circuit board 17 is disposed inside the connector engagement chamber 26. The printed circuit board 17 and the guide wall 4 face to each other and are arranged in parallel with each other. The base edge 16a of the tapered guide surfaces 16 of the guide wall 4 is situated between the opening 13 of the connector housing 3 and the partition wall 22.

A unit receiving portion 27 for receiving the electrical equipment unit 1 is provided to the instrument panel 9. Above the unit receiving portion 27, a guide receiving portion 28 for receiving the guide wall 4 is formed. As shown in FIG. 3, the guide receiving portion 28 has a pair of L-shaped rails 30 hanging down from the horizontal wall 29 of the instrument panel 9. The flange portions 14 of the guide wall 4 of the unit 1 slide along the inner grooves 13 of the rails 30.

In FIG. 2, the opening edge 33 of the instrument panel is situated at the front edge of the horizontal wall 29 of the unit receiving portion 27 via a step portion 32. The stand wall 7 of the unit 1 is inserted into the step portion 32, and the flange portion 8 of the unit 1 is brought into contact with the opening edge 33.

A male connector 34 is disposed in the vicinity of the guide receiving portion 28. The male connector 34 is secured to the upper portion of the back wall of the unit receiving unit 27. The upper wall surface 37 of a male connector housing 36 is situated at the same height as the inner horizontal surfaces 30*a* of the rails 30, and brought into contact with the lower surface 4*a* of the guide wall 4. The male connector housing 36 is inserted into the connector engagement chamber 26 of the female connector housing 3.

The front edge 38 of the male connector housing 34 is situated at the mid-point on the guide receiving portion 28 in the horizontal direction (in the longitudinal direction). Distance $L_1$ from the front edge 39 of the guide receiving portion 28 to the front edge 38 of the male connector housing 36 is longer than the distance from the front edge 18 of the guide wall 4 to the base edge 16a of the tapered guide surfaces 16, or at least than distance $L_2$ from the front edge 13 of the female connector housing 3 to the base edge 16*a* of the tapered guide surfaces 16 of the guide wall 4. Because of this, after the guide wall 4 is engaged with the guide receiving portion 28, the female connector 21 is engaged with the male connector 34.

A female terminal 41 having an elastic contact member 40 for receiving the card edge connector 20 is disposed inside the male connector housing 36. The female terminal 41 is connected to a wire harness (not shown) of the instrument panel 9. The male connector housing 36 and the female terminal 41 constitute the male connector 34.

As described above, the guide wall 4 is formed unitarily with the female connector 21, and the male connector 34 is disposed right below the guide receiving portion 28. As a result, the accuracy in assembling is increased, and disalignment of the connectors 21 and 34 caused by inserting the guide wall 4 into the guide receiving portion 28 can be minimized. Accordingly, the male connector 34 needs not to be movable as in the prior art. By allowing the female connector 21 and the male connector 34 small spaces in both vertical and horizontal directions, smooth and secure connector connection can be conducted.

By virtue of the above construction, reliability of the unit connecting portion is increased, and the connectors 21 and 34 can be simplified and made more compact. Thus, the number of components required can be reduced. Also, assembling the unit 1 can be simplified. In particular, compared with a guide pin (not shown) often used in positioning connectors in the prior art, the guide wall 4 of the present invention enables further simplification of connectors and reduction in the number of components.

Due to the relationship in size, when the unit 1 is assembled and connected, the guide wall 4 of the unit 1 is adjusted to the guide receiving portion 28 of the instrument panel 9. The unit 1 is then pushed into the guide receiving portion 28. After the secure engagement of the guide wall 4 with the guide receiving portion 28, the engagement of the connectors 21 and 34 is started. When the unit 1 is fully inserted into the unit receiving portion 27, the engagement of the connectors 21 and 34 is also completed. Accordingly, assembling the unit 1 and connecting the connectors 21 and 34 can be conducted smoothly and securely.

Since there is no wire harness used in the unit 1, dragging a wire harness can be avoided in connecting operations.

In the above embodiment, it should be noted that the guide wall 4 is not limited to the upper wall of the connector housing 3, but one of the output walls of the connector housing (hood) 3 may serve as the guide wall 4. Any of the side walls 12 and the lower wall 6 of the connector housing 3 may also serve as the guide wall 4.

Figure 4:
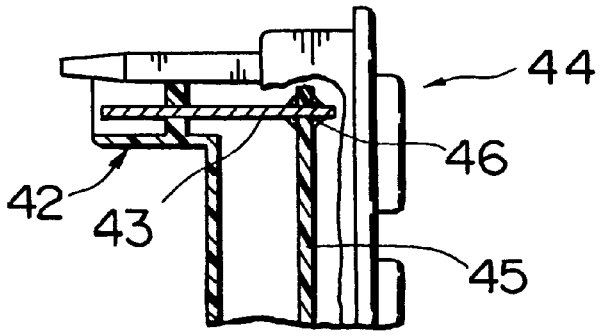
FIG. 4 is a vertical sectional view of a second embodiment of the attachment and connection structure of the electrical equipment unit in accordance with the present invention.

FIG. 4 shows another embodiment of a connector of an electrical equipment unit.

This connector 42 is provided with a pin terminal 43 instead of the card edge connector 20. The pin terminal 43 is connected to a vertical circuit board 45 of a unit 44 by a solder. The pin terminal 43 is connected to an elastic contact member 40 (shown in FIG. 2) as in the first embodiment.

Figure 5:
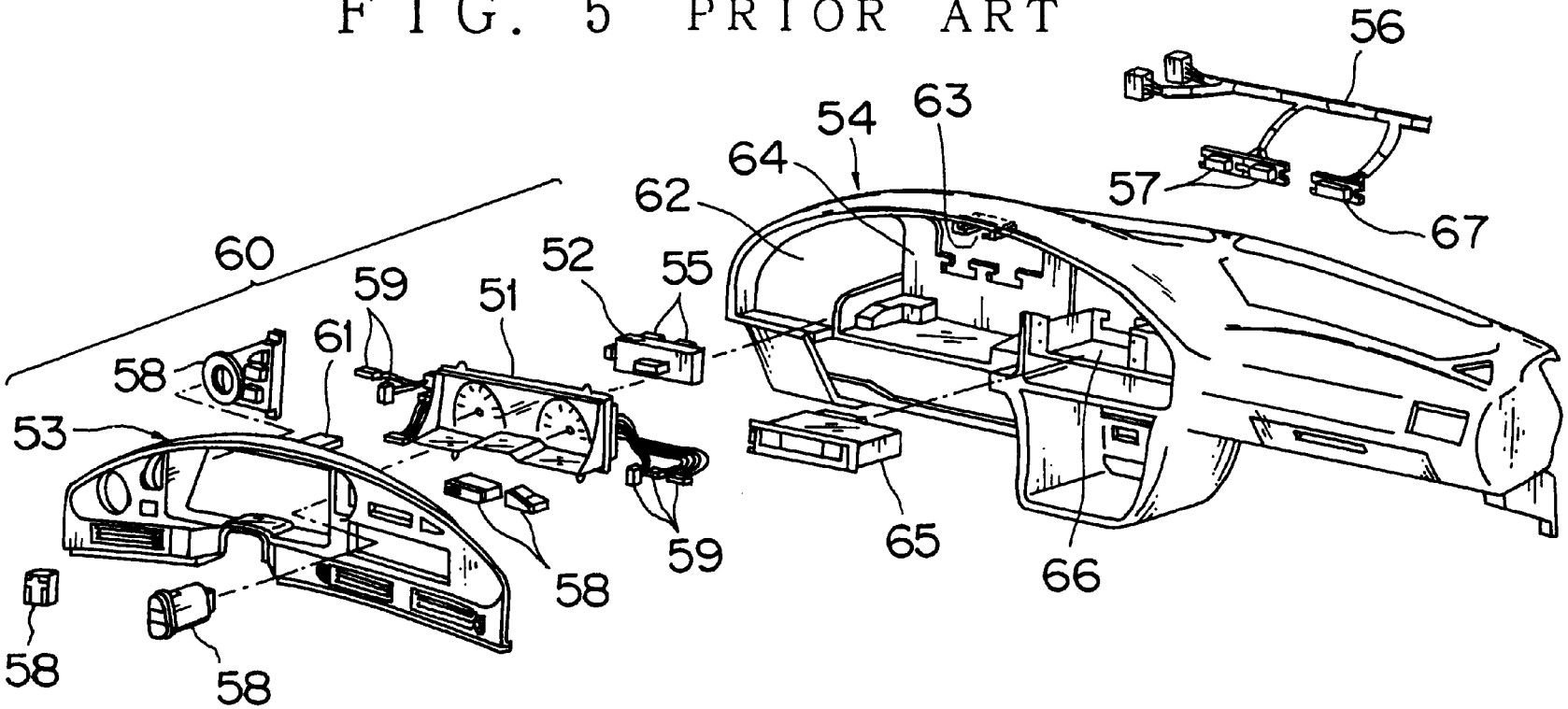
FIG. 5 PRIOR ART
FIG. 5 is an exploded perspective view illustrating the prior art.

The electrical equipment unit 1 is mounted to a finish panel (see FIG. 5) and thereby constitutes a cluster module (now shown). When the cluster module is mounted to the instrument panel 9, the guide wall 4 of the electrical equipment unit 1 is engaged with the guide receiving portion 28 so as to adjust the positions of both connectors. Thus, smooth and secure connector connection can be conducted, and the cluster module can be smoothly mounted to the instrument panel 9 by virtue of the guide wall 4. The electrical equipment unit 1 may also be mounted and connected to the instrument panel 9, and after that, the finish panel is mounted to the instrument panel 9, thereby making sure of secure mounting and connection of the electrical equipment unit 1.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An attachment and connection structure of an electrical equipment unit, comprising:

a connector attached to the electrical equipment unit:

a mating connector having a unit receiving portion for the mating connector to be connected to the connector;

a guide wall formed unitarily on the connector, the guide wall having flange portion protruding from both sides of the connector and protruding from a front edge of the connector; and a guide receiving portion for receiving the guide wall provided to the unit receiving portion, wherein the mating connector is disposed adjacent the guide receiving portion, and when the electrical equipment unit is attached to the unit receiving portion by insertion of the guide wall into the guide receiving portion, the connector is connected to the mating connector.

2. The attachment and connection structure according to claim 1, wherein top and bottom surfaces and both side surfaces of a protruding portion at the edge of the guide wall are tapered.

3. The attachment and connection structure according to claim 1, wherein the guide receiving portion includes a horizontal wall and a pair of rails hanging down from the horizontal wall, each with an L-shaped rail and a reversed-L-shaped cross section.

4. The attachment and connection structure according to claim 1, wherein the connector includes the guide wall that serves as a part of the outer walls thereof, and a connector engagement chamber.

5. The attachment and connection structure according to any of claims 1 or 4, wherein after the guide wall is engaged with the guide receiving portion, engaging the connector with the mating connector is started.

6. The attachment and connection structure according to claim 4, wherein the edge portion of a circuit board of the electrical equipment unit is situated inside the connector engagement chamber.

* * * * *